US008736538B2

(12) United States Patent
Al-Dahle

(10) Patent No.: US 8,736,538 B2
(45) Date of Patent: May 27, 2014

(54) DEVICES AND METHODS FOR REDUCING A VOLTAGE DIFFERENCE BETWEEN VCOMS OF A DISPLAY

(75) Inventor: Ahmad Al-Dahle, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 178 days.

(21) Appl. No.: 13/479,066

(22) Filed: May 23, 2012

(65) Prior Publication Data

US 2013/0241909 A1 Sep. 19, 2013

Related U.S. Application Data

(60) Provisional application No. 61/612,068, filed on Mar. 16, 2012.

(51) Int. Cl.
*G09G 3/36* (2006.01)

(52) U.S. Cl.
USPC ..... 345/100; 345/211

(58) Field of Classification Search
CPC . G09G 3/3266; G09G 3/3655; G09G 3/3659; G09G 3/3644; G09G 2300/0819; G09G 2320/0204; G09G 2320/0209; G09G 2320/0214; G09G 2320/0219; G09G 2320/0223
USPC ..... 345/211–215, 87–100
See application file for complete search history.

(56) References Cited

U.S. PATENT DOCUMENTS

| | | | | |
|---|---|---|---|---|
| 5,841,410 | A * | 11/1998 | Oda et al. | 345/58 |
| 6,392,626 | B1 * | 5/2002 | Moon | 345/94 |
| 6,756,958 | B2 * | 6/2004 | Furuhashi et al. | 345/95 |
| 6,762,565 | B2 * | 7/2004 | Kudo et al. | 315/169.2 |
| 7,302,157 | B2 | 11/2007 | Chui | |
| 7,504,873 | B2 | 3/2009 | Bourgoin et al. | |
| 8,552,945 | B2 * | 10/2013 | Lim | 345/87 |
| 2005/0195149 | A1 * | 9/2005 | Ito | 345/98 |
| 2005/0264472 | A1 | 12/2005 | Rast | |
| 2006/0092109 | A1 * | 5/2006 | Hsu et al. | 345/87 |
| 2007/0035499 | A1 * | 2/2007 | Lee et al. | 345/94 |
| 2011/0298785 | A1 | 12/2011 | Al-Dahle et al. | |
| 2012/0162182 | A1 * | 6/2012 | Lin et al. | 345/212 |

* cited by examiner

*Primary Examiner* — Liliana Cerullo
(74) *Attorney, Agent, or Firm* — Fletcher Yoder PC

(57) ABSTRACT

Methods and devices for reducing a voltage difference between common voltage layers (VCOMs) of a display are provided. In one example, a method may include supplying an activation signal to a row of pixels of the display to activate the row of pixels. The method may also partially removing the activation signal from the row of pixels at a predetermined rate. The method may include detecting a voltage difference between a first VCOM of a first set of pixels of the display and a second VCOM of a second set of pixels of the display after the activation signal has been partially removed. The method may also include controlling removal of the activation signal from the row of pixels based at least partially on the detected voltage difference.

20 Claims, 8 Drawing Sheets

DEVICES AND METHODS FOR REDUCING A VOLTAGE DIFFERENCE BETWEEN VCOMS OF A DISPLAY

CROSS REFERENCE TO RELATED APPLICATIONS

This application is a Non-Provisional Patent Application of U.S. Provisional Patent Application No. 61/612,068, entitled "Devices and Methods for Reducing a Voltage Difference Between VCOMS of a Display", filed Mar. 16, 2012, which is herein incorporated by reference.

BACKGROUND

The present disclosure relates generally to electronic displays and, more particularly, to liquid crystal displays (LCDs) that can reduce a voltage difference between common voltage layers (VCOMs) of an LCD to improve image quality of the LCDs.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), are commonly used in electronic devices such as televisions, computers, and phones. LCDs portray images by modulating the amount of light that passes through a liquid crystal layer within pixels of varying color. For example, by varying a voltage difference between a pixel electrode and a common electrode in a pixel, an electric field may result. The electric field may cause the liquid crystal layer to vary its alignment, which may ultimately result in more or less light being emitted through the pixel where it may be seen. By changing the voltage difference (often referred to as a data signal) supplied to each pixel, images may be produced on the LCD.

To store data representing a particular amount of light that is to be passed through pixels, gates of thin-film transistors (TFTs) in the pixels may be activated while the data signal is supplied to the pixels. When the TFT gates are deactivated, a kickback voltage may alter the voltage stored in the pixels. In certain configurations, the LCD may include a segmented VCOM such that a portion of the pixels of the LCD use a first VCOM and a portion of the pixels of the LCD use a second VCOM. In such a configuration, the kickback voltage for the pixels using the first VCOM may be different than the kickback voltage for the pixels using the second VCOM. Accordingly, the kickback voltage difference between the pixels may result in undesirable image quality (e.g., pixels using the first VCOM may display an image differently than pixels using the second VCOM).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for reducing a voltage difference between common voltage layers (VCOMs) of a display to improve image quality of the display. By way of example, a method for reducing a voltage different between VCOMs of a display may include supplying an activation signal to a row of pixels of the display to activate the row of pixels. The method may also include partially removing the activation signal from the row of pixels at a predetermined rate. The method may include detecting a voltage difference between a first VCOM of a first set of pixels of the display and a second VCOM of a second set of pixels of the display after the activation signal has been partially removed. The method may also include controlling removal of the activation signal from the row of pixels based at least partially on the detected voltage difference.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
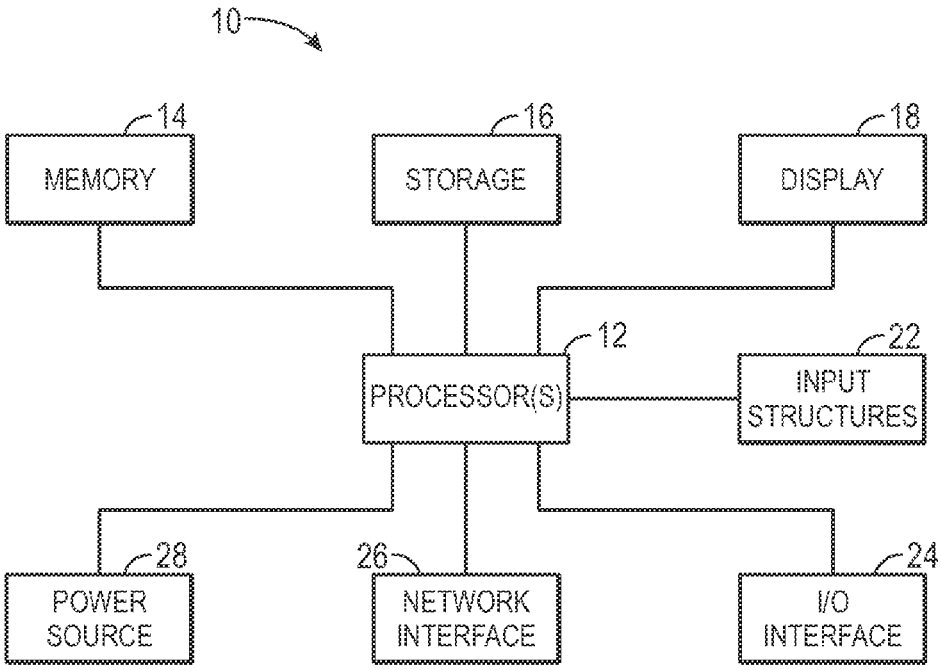
FIG. 1 is a schematic block diagram of an electronic device with a liquid crystal display (LCD) that can reduce a voltage difference between common voltage layers (VCOMs) of the LCD to improve image quality of the LCD, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, embodiments of the present disclosure relate to liquid crystal displays (LCDs) and electronic devices incorporating LCDs that employ a device, method, or combination thereof for controlling removal of a pixel activation signal to decrease a voltage difference between different common voltage layers (VCOMs) of the LCD. Specifically, rather than allowing the activation signal to be supplied and/or removed with default characteristics, which could result in undesirable image quality (e.g., color variations between different portions of the LCD), embodiments of the present disclosure may incorporate hardware, software, or a combination thereof for controlling the application and/or removal of the activation signal to reduce a voltage difference between VCOMs of the LCD.

Specifically, to reduce a voltage difference between VCOMs of the LCD, an activation signal is applied to a row of pixels. With the activation signal applied, the gates of the TFTs remain open, thereby allowing current flow between the source and drain of the TFTs. The gates of the TFTs are partially closed at a predetermined rate to limit current flow between the source and drain of the TFTs. After the gates of the TFTs are partially closed, the voltage difference between VCOMs of the LCD is detected. The gates of the TFTs are controlled to completely close at a certain rate and/or time to decrease the voltage difference between VCOMs of the LCD. As a result, it is believed that the voltage difference of the VCOMs may be reduced and, accordingly, image quality between portions of the LCD using different VCOMs may be improved.

Figure 2:
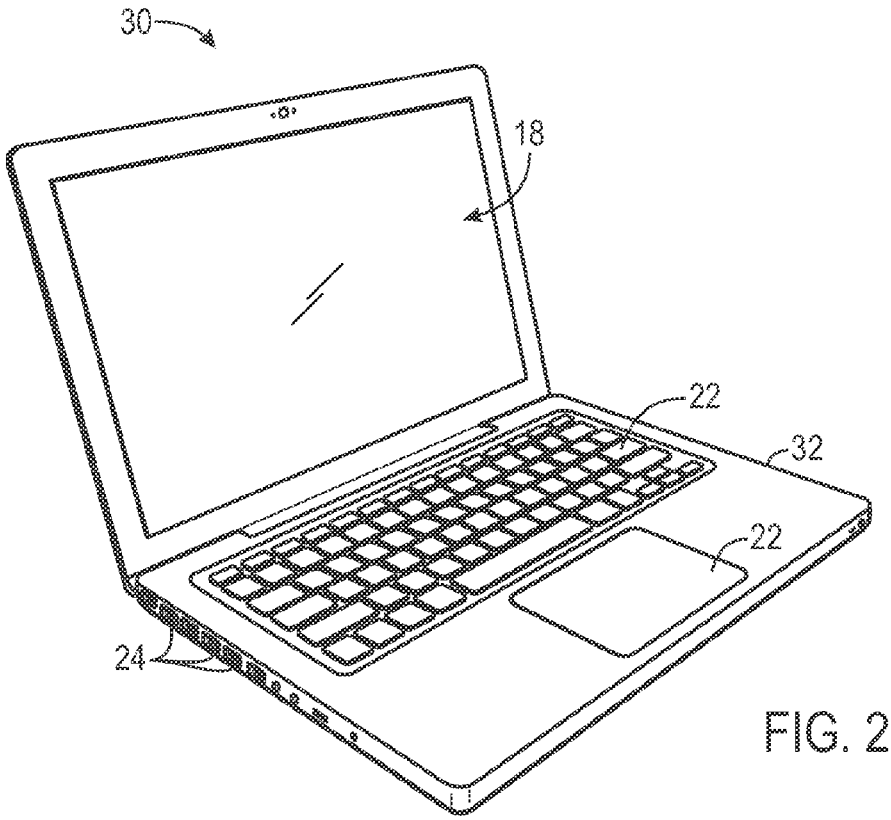
FIG. 2 is a perspective view of a notebook computer representing an embodiment of the electronic device of FIG. 1.
Figure 3:
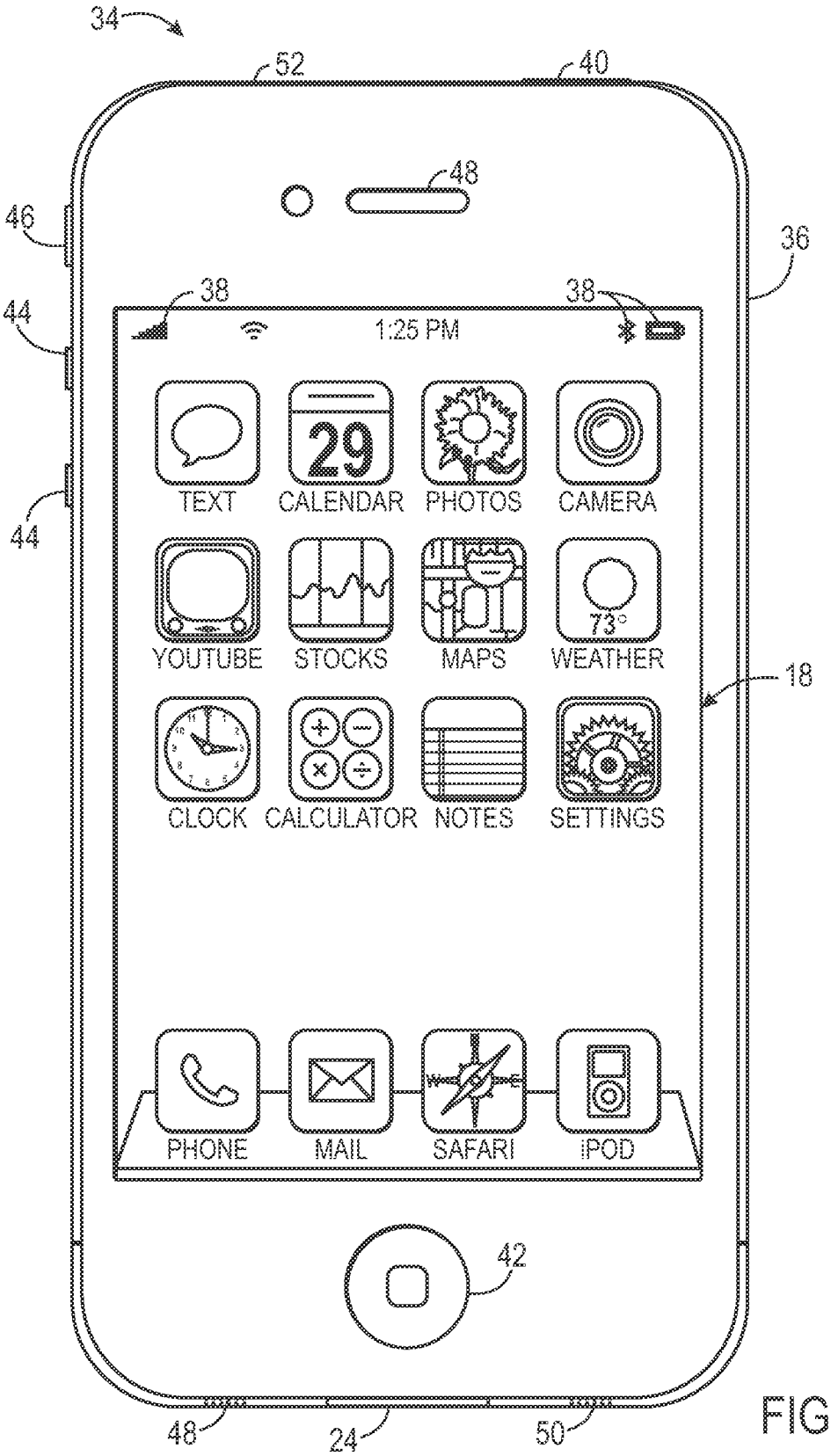
FIG. 3 is a front view of a handheld device representing another embodiment of the electronic device of FIG. 1.

With the foregoing in mind, a general description of suitable electronic devices that may employ electronic displays having capabilities to control removal of activation signals to reduce voltage difference between VCOMs is described below. In particular, FIG. 1 is a block diagram depicting various components that may be present in an electronic device suitable for use with such a display. FIGS. 2 and 3 respectively illustrate perspective and front views of a suitable electronic device, which may be, as illustrated, a notebook computer or a handheld electronic device.

Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10. As will be appreciated, when there is a voltage difference between VCOMs of the display 18, image quality of the display 18 may be distorted. For example, portions of the display 18 using one VCOM may produce different colors than portions of the display 18 using a different VCOM. As such, embodiments of the present disclosure may be employed to increase image quality.

By way of example, the electronic device 10 may represent a block diagram of the notebook computer depicted in FIG. 2, the handheld device depicted in FIG. 3, or similar devices. It should be noted that the processor(s) 12 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10. As presented herein, the data processing circuitry may control the gates of the TFTs of the electronic display 18 to reduce a voltage difference between VCOMs of the display 18.

In the electronic device 10 of FIG. 1, the processor(s) 12 and/or other data processing circuitry may be operably coupled with the memory 14 and the nonvolatile memory 16 to execute instructions. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12.

The display 18 may be a touch-screen liquid crystal display (LCD), for example, which may enable users to interact with a user interface of the electronic device 10. In some embodiments, the electronic display 18 may be a MultiTouch™ display that can detect multiple touches at once. As will be described further below, the electronic device 10 may include circuitry to control the gates of the TFTs of the display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on the display 18. Further, the display 18 may include TFTs that are controlled to reduce voltage differences of VCOMs of the display 18.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate a user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones. As mentioned above, the display 18 may include TFTs that are controlled to reduce voltage difference of VCOMs of the display 18.

Figure 4:
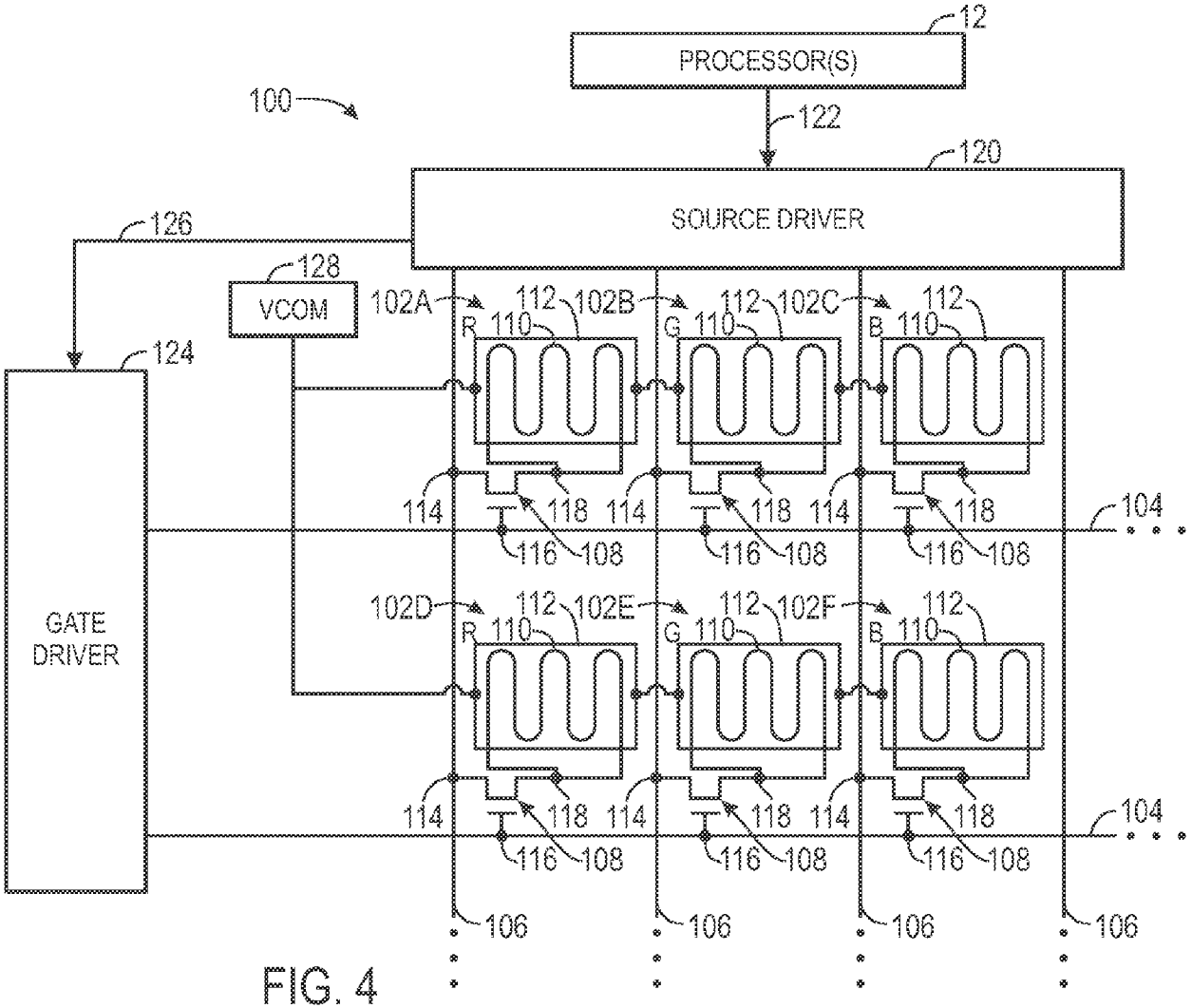
FIG. 4 is a circuit diagram illustrating display circuitry used to reduce a voltage difference between VCOMs of an LCD to improve image quality of the LCD, in accordance with an embodiment.

Among the various components of an electronic display 18 may be a pixel array 100, as shown in FIG. 4. As illustrated, FIG. 4 generally represents a circuit diagram of certain components of the display 18 in accordance with an embodiment. In particular, the pixel array 100 of the display 18 may include a number of unit pixels 102 disposed in a pixel array or matrix. In such an array, each unit pixel 102 may be defined by the intersection of rows and columns, represented by gate lines 104 (also referred to as scanning lines), and source lines 106 (also referred to as data lines), respectively. Although only six unit pixels 102, referred to individually by the reference numbers 102A-102F, respectively, are shown for purposes of simplicity, it should be understood that in an actual implementation, each source line 106 and gate line 104 may include hundreds or thousands of such unit pixels 102. Each of the unit pixels 102 may represent one of three subpixels that respectively filters only one color (e.g., red, blue, or green) of light. For purposes of the present disclosure, the terms "pixel," "subpixel," and "unit pixel" may be used largely interchangeably.

In the presently illustrated embodiment, each unit pixel 102 includes a thin film transistor (TFT) 108 for switching a data signal supplied to a respective pixel electrode 110. The potential stored on the pixel electrode 110 relative to a potential of a common electrode 112, which may be shared by other pixels 102, may generate an electrical field sufficient to alter the arrangement of a liquid crystal layer of the display 18. In the depicted embodiment of FIG. 4, a source 114 of each TFT 108 may be electrically connected to a source line 106 and a gate 116 of each TFT 108 may be electrically connected to a gate line 104. A drain 118 of each TFT 108 may be electrically connected to a respective pixel electrode 110. Each TFT 108 may serve as a switching element that may be activated and deactivated (e.g., turned on and off) for a period of time based on the respective presence or absence of a scanning or activation signal on the gate lines 104 that are applied to the gates 116 of the TFTs 108.

When activated, a TFT 108 may store the image signals received via the respective source line 106 as a charge upon its corresponding pixel electrode 110. As noted above, the image signals stored by the pixel electrode 110 may be used to generate an electrical field between the respective pixel electrode 110 and a common electrode 112. This electrical field may align the liquid crystal molecules within the liquid crystal layer to modulate light transmission through the pixel 102. Thus, as the electrical field changes, the amount of light passing through the pixel 102 may increase or decrease. In general, light may pass through the unit pixel 102 at an intensity corresponding to the applied voltage from the source line 106.

The display 18 also may include a source driver integrated circuit (IC) 120, which may include a processor, microcontroller, or application specific integrated circuit (ASIC), that controls the display pixel array 100 by receiving image data 122 from the processor(s) 12 and sending corresponding image signals to the unit pixels 102 of the pixel array 100. It should be understood that the source driver 120 may be a chip-on-glass (COG) component on a TFT glass substrate, a component of a display flexible printed circuit (FPC), and/or a component of a printed circuit board (PCB) that is connected to the TFT glass substrate via the display FPC. Further, the source driver 120 may include any suitable article of manufacture having one or more tangible, computer-readable media for storing instructions that may be executed by the source driver 120.

The source driver 120 also may couple to a gate driver integrated circuit (IC) 124 that may activate or deactivate rows of unit pixels 102 via the gate lines 104. As such, the source driver 120 may provide timing signals 126 to the gate driver 124 to facilitate the activation/deactivation of individual rows (i.e., lines) of pixels 102. In other embodiments, timing information may be provided to the gate driver 124 in some other manner. The display 18 may include a Vcom source 128 to provide a VCOM output to the common electrodes 112. In some embodiments, the Vcom source 128 may supply a different VCOM to different common electrodes 112 at different times. In other embodiments, the common electrodes 112 all may be maintained at the same potential (e.g., a ground potential) while the display 18 is on.

Figure 5:
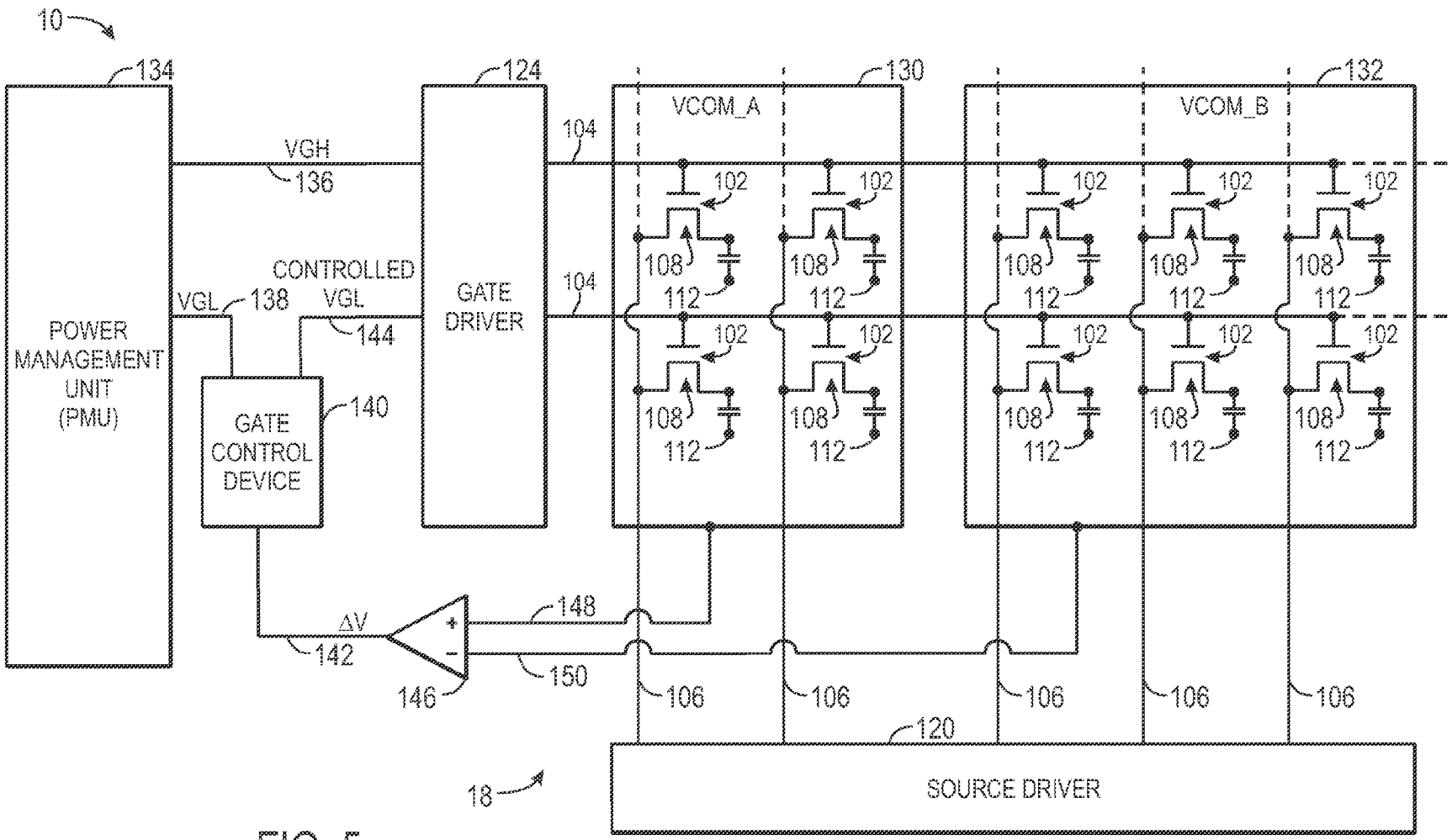
FIG. 5 is a circuit diagram illustrating circuitry of an electronic device for controlling a voltage difference between VCOMs of an LCD to improve image quality of the LCD, in accordance with an embodiment.

There are many ways to configure the circuitry of the electronic device 10 so that gates 116 used to activate pixels 102 of the electronic display 18 may be controlled to decrease a voltage difference between VCOMs of the display 18. FIG. 5 generally represents one embodiment of a circuit diagram of components of the electronic device 10 for controlling a voltage difference between VCOMs of the display 18 to improve image quality of the display 18. In particular, the electronic device 10 includes a VCOM_A 130 and a VCOM_B 132. As illustrated, the VCOM_A 130 and the VCOM_B 132 each have multiple pixels 102 coupled thereon. Specifically, the common electrodes 112 of the illustrated pixels 102 are electrically coupled to either VCOM_A 130 or VCOM_B 132. Although four pixels 102 are illustrated as being electrically coupled to VCOM_A 130 and six pixels 102 are illustrated as being electrically coupled to VCOM_B 132, any suitable number of pixels 102 may be electrically coupled to VCOM_A 130 and to VCOM_B 132.

The electronic device 10 of the present embodiment includes a power management unit (PMU) 134. The PMU 134 is used to manage the power of the electronic device 10 and may control when power is applied to, or removed from, other components of the electronic device 10. For example, the PMU 134 provides a high gate voltage (VGH) 136 to the gate driver 124. In the present embodiment, the PMU 134 provides a low gate voltage (VGL) 138 to a gate control device 140. The gate control device 140 receives a voltage difference 142 and uses the voltage difference 142 to produce a controlled VGL 144 that is provided to the gate driver 124. As will be appreciated, the gate driver 124 may use the VGH 134 to apply an activation voltage to the gate lines 104, while the gate driver 124 may use the controlled VGL 144 to apply a deactivation voltage to the gate lines 104. As such, the gate driver 124 may be configured to couple together either the VGH 134 or the controlled VGL 144 to the gate lines 104.

A voltage sensing device 146 is used to determine the voltage difference 142 between a first input 148 and a second input 150. In the present embodiment, the first input 148 is electrically coupled to the VCOM_A 130 and the second input 150 is electrically coupled to the VCOM_B 132. Accordingly, the voltage sensing device 146 detects the voltage difference 142 between the VCOM_A 130 and the VCOM_B 132. The voltage sensing device 146 may be any suitable voltage sensing device, such as an electronic amplifier (e.g., operational amplifier, differential amplifier, etc.).

As illustrated, the VCOM_A 130 and the VCOM_B 132 may not physically be the same size. Accordingly, the voltage difference 142 between the VCOM_A 130 and the VCOM_B 132 may result from resistive differences between the VCOM_A 130 and the VCOM_B 132. For example, when one of the gate lines 104 is deactivated, voltages stored on pixels 102 may change due to kickback voltage. As will be appreciated, the kickback voltage may not be the same for the VCOM_A 130 and the VCOM_B 132 due to their resistive differences. Therefore, the voltage sensing device 146 may detect the voltage difference 142.

To reduce the voltage difference 142, the voltage sensing device 146 provides the voltage difference 142 to the gate control device 140. The gate control device 140 may use the voltage difference 142 to modify the VGL 138 and provide the controlled VGL 144 to the gate driver 124. Specifically, after the gate control device 140 receives the VGL 138 indicating that the gates 116 should be deactivated, the gate control device 140 may modify the VGL 138 based at least partially on the voltage difference 142 to produce the controlled VGL 144. For example, the gate control device 140 may modify the rate that the activation voltage on the gate lines 104 transitions to the deactivation voltage. By modifying the rate that the gate lines 104 transition from the activation voltage to the deactivation voltage, the voltage difference 142 between the VCOM_A 130 and the VCOM_B 132 may be reduced. As will be appreciated, the gate control device 140 may use a mapping table to determine a rate that the gate lines 104 should transition to the deactivation voltage for a particular voltage difference 142. For example, the mapping table may include multiple voltage differences and rates of deactivation that correspond to each voltage difference.

Figure 6:
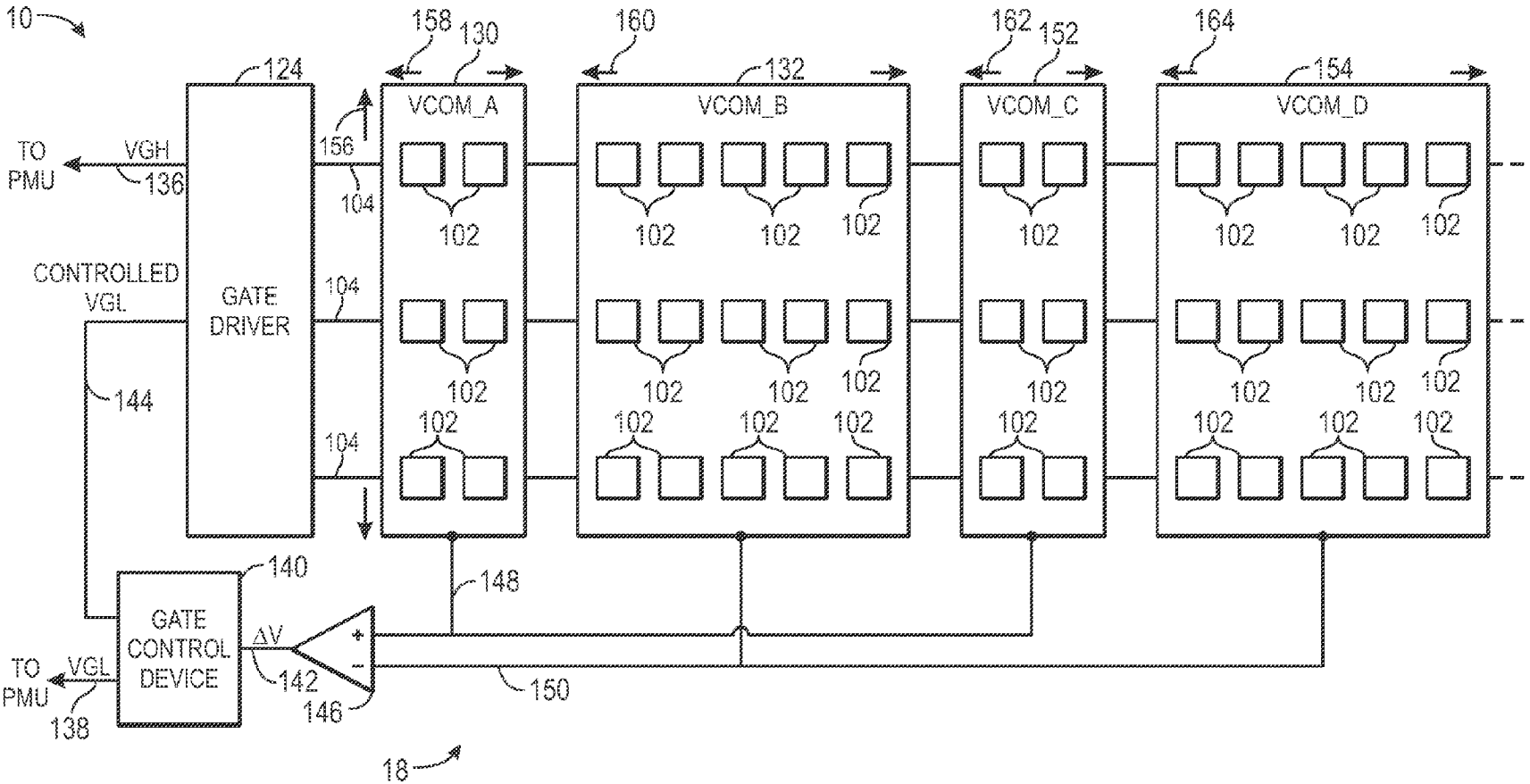
FIG. 6 is a circuit diagram illustrating circuitry of an electronic device for controlling a voltage difference between sets of VCOMs of an LCD to improve image quality of the LCD, in accordance with an embodiment.

The display 18 may have any number of VCOMs and the VCOMs may vary in size. FIG. 6 generally represents a diagram of circuitry of the electronic device 10 for controlling a voltage difference between sets of VCOMs of the display 18 to improve image quality of the display 18. Specifically, in the present embodiment, the display 18 includes the VCOM_A 130, the VCOM_B 132, a VCOM_C 152, and a VCOM_D 154. As illustrated, each of the VCOM_A 130, the VCOM_B 132, the VCOM_C 152, and the VCOM_D 154 generally have a length 156. Further, the VCOM_A 130 has a width 158, the VCOM_B 132 has a width 160, the VCOM_C 152 has a width 162, and the VCOM_D 154 has a width 164. In certain embodiments, the width 158 and the width 162 may generally be the same. In addition, the width 160 and the width 164 may generally be the same. Accordingly, the input 148 may be coupled to the VCOM_A 130 and the VCOM_C 152 (e.g., because they are generally the same size and will generally have similar resistive qualities), while the input 150 may be coupled to the VCOM_B 132 and the VCOM_D 154 (because they are generally the same size and will generally have similar resistive qualities). Therefore, in the present embodiment a single voltage sensing device may be used.

Figure 7:
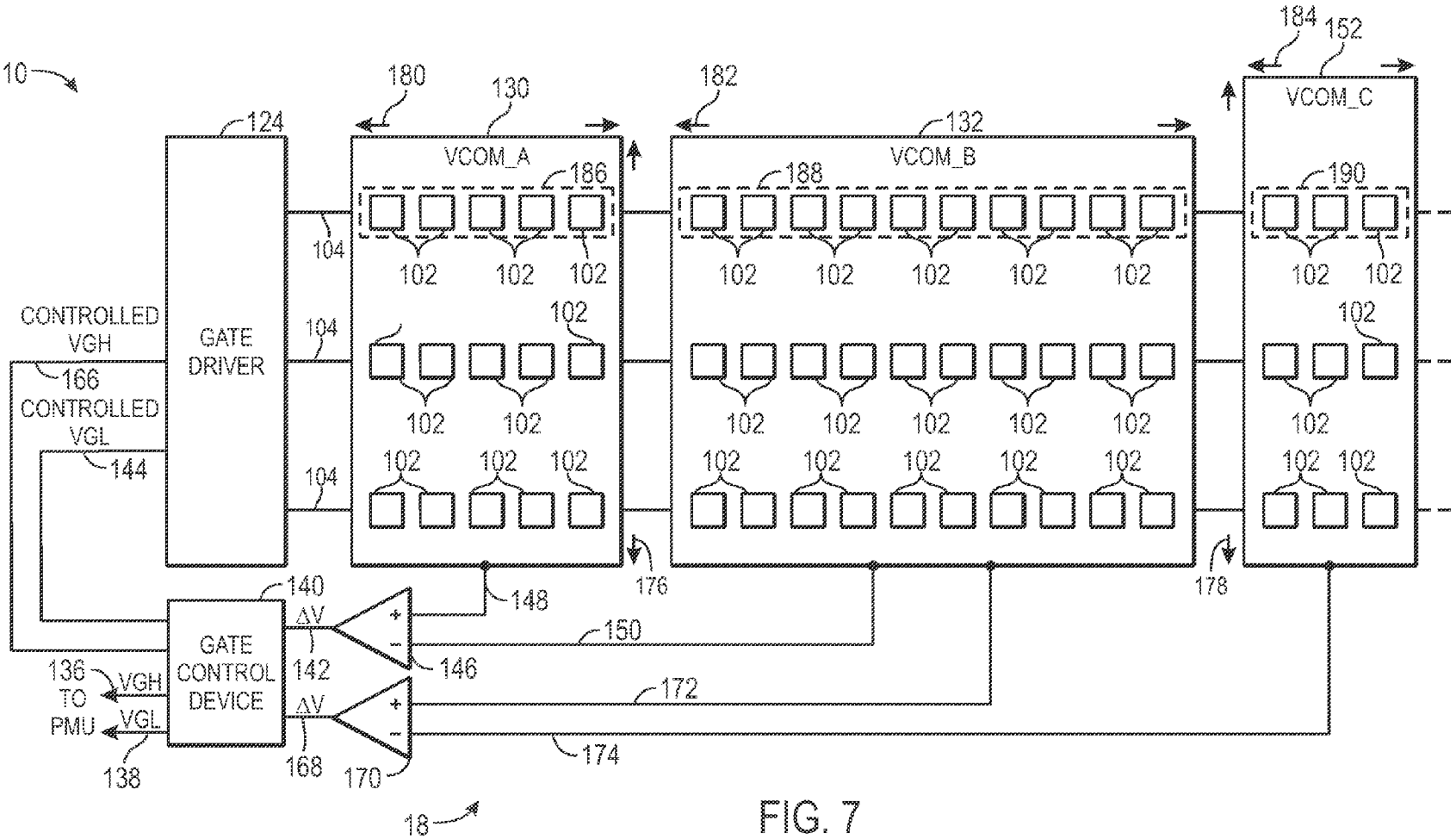
FIG. 7 is a circuit diagram illustrating circuitry of an electronic device having multiple voltage sensing devices for sensing voltage differences between VCOMs of an LCD, in accordance with an embodiment.

The display 18 may have more than one voltage sensing device (e.g., when there are more than two sizes of VCOMs). Accordingly, FIG. 7 illustrates one embodiment of circuitry of the electronic device 10 having multiple voltage sensing devices for sensing voltage differences between VCOMs of the display 18. In the present embodiment, the gate control device 140 is configured to receive the VGH 136 and the VGL 138. As such, the gate control device 140 provides a controlled VGH 166 and the controlled VGL 144 to the gate driver 124. Thus, the gate control device 140 may control the rates and/or timing of the activation and deactivation voltages that are applied to the gates 116 via the gate lines 104, as explained in detail below in relation to FIG. 9.

Further, the gate control device 140 receives a second voltage difference 168 from a second voltage sensing device 170. As illustrated, the voltage sensing device 146 receives inputs 148 and 150, which are electrically coupled to the VCOM_A 130 and the VCOM_B 132, respectively. The second voltage sensing device 170 receives inputs 172 and 174, which are electrically coupled to the VCOM_B 132 and the VCOM_C 152, respectively. Accordingly, the gate control device 140 may receive the voltage difference 142 (e.g., the voltage difference between the VCOM_A 130 and the VCOM_B 132) and the voltage difference 170 (e.g., the voltage difference between the VCOM_B 132 and the VCOM_C 152). Although the gate control device 140 does not receive a voltage difference between the VCOM_A 130 and the VCOM_C 152, the gate control device 140 may determine such a voltage difference. The gate control device 140 may use a mapping table where each row includes two voltage differences (e.g., for two voltage sensing devices) that together correspond to a rate of deactivation for the two voltage differences.

As illustrated, the VCOM_A 130 and the VCOM_B 132 may each have a length 176, while the VCOM_C 152 has a length 178. Further, the VCOM_A 130, the VCOM_B 132, and the VCOM_C 152 may have widths 180, 182, and 184, respectively. Accordingly, the VCOM_A 130, the VCOM_B 132, and the VCOM_C 152 may each be a different size and therefore may have different resistive characteristics. As such, two voltage sensing devices 146 and 170 may be used to detect the voltage differences between the VCOMs. As will be appreciated, in embodiments with a greater number if different sizes of VCOMs, the number of voltage sensing devices may increase. It should be noted that each gate line 104 may include a subset of pixels 102 from each VCOM. For example, one gate line 104 includes a subset 186 from the VCOM_A 130, a subset 188 from the VCOM_B 132, and a subset 190 from the VCOM_C 152.

Figure 8:
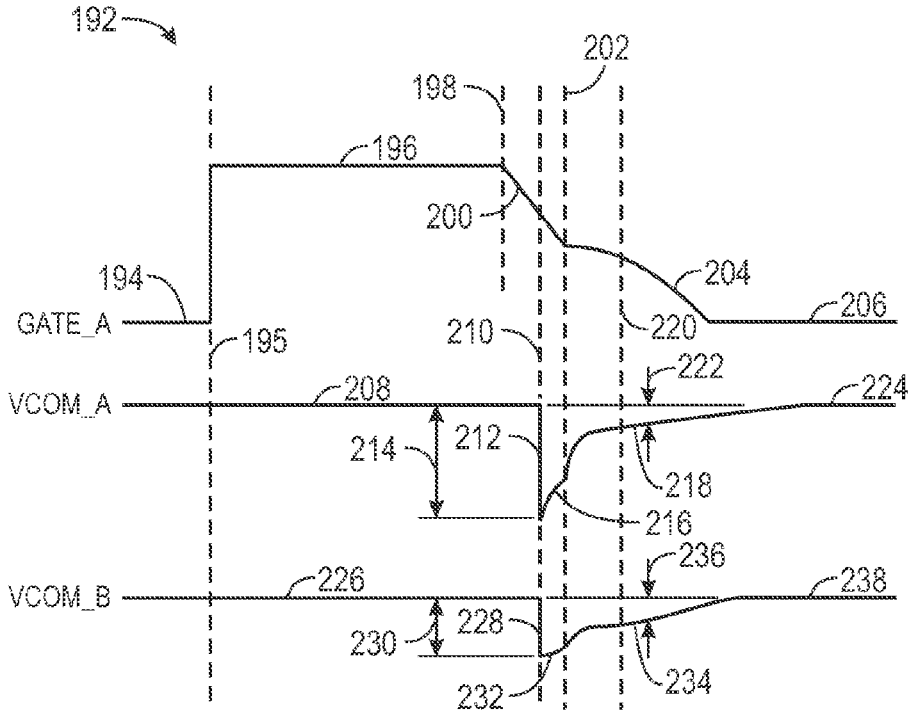
FIG. 8 is a timing diagram illustrating a reduction of a voltage difference between VCOMs of an LCD by controlling a rate that an activation signal is removed from pixels to improve image quality of the LCD, in accordance with an embodiment.

In certain embodiments, the rate that an activation signal is removed from pixels 102 is controlled to decrease the voltage difference between VCOMs. FIG. 8 illustrates one embodiment of a timing diagram 192 that shows a reduction of the voltage difference 142 between VCOMs of the display 18 by controlling a rate that a voltage on a gate line 104 (e.g., GATE_A) is removed from pixels 102 to improve image quality of the display 18. As illustrated by segment 194, the gate line 104 may start in a logic low (deactivated) state. At a time 195, the gate line 104 may transition to a logic high (activated) state where it remains through segment 196. At a time 198, the gate line 104 may begin to transition toward the logic low state at a fixed rate, during segment 200. The fixed rate of transition may be a predetermined rate configured to be applied for a fixed period of time (e.g., until a time 202). At the time 202, the transition rate toward the logic low state may become variable (e.g., actively controlled) and may be based on the voltage difference 142, in order to decrease the voltage difference 142 between the VCOM_A 130 and the VCOM_B 132, as shown by segment 204. After the gate line 104 reaches the logic low state, the gate line 104 remains in the logic low state, as shown by segment 206.

In the present embodiment, a voltage is applied to the VCOM_A 130 during segment 208. At a time 210, a kickback voltage alters the voltage of the VCOM_A 130, as shown by segment 212. As illustrated, the voltage of the VCOM_A 130 may change by a voltage 214. The voltage of the VCOM_A 130 then begins to return to the voltage applied during segment 208, as shown by segments 216 and 218. Segment 216 corresponds to the rate that the gate line 104 is deactivated during segment 200, while segment 218 corresponds to the rate that the gate line 104 is deactivated during segment 204. At a time 220, the voltage of the VCOM_A 130 may vary from the voltage applied during segment 208 by a voltage 222. During segment 224, the voltage of the VCOM_A 130 may be approximately the same as the voltage applied during segment 208.

A voltage is applied to the VCOM_B 132 during segment 226. At the time 210, a kickback voltage alters the voltage of the VCOM_B 132, as shown by segment 228. As illustrated, the voltage of the VCOM_B 132 may change by a voltage 230. The voltage of the VCOM_B 132 then begins to return to the voltage applied during segment 226, as shown by segments 232 and 234. Segment 232 corresponds to the rate that the gate line 104 is deactivated during segment 200, while segment 234 corresponds to the rate that the gate line 104 is deactivated during segment 204. At the time 220, the voltage of the VCOM_B 132 may vary from the voltage applied during segment 226 by a voltage 236. During segment 238, the voltage of the VCOM_B 132 may be approximately the same as the voltage applied during segment 226.

In certain embodiments, the voltage applied to the VCOM_A 130 and the VCOM_B 132 may be approximately the same and, therefore, the voltage difference 142 between the VCOM_A 130 and the VCOM_B 132 during segments 208 and 226 may be approximately zero. Furthermore, the voltage difference 142 between the VCOM_A 130 and the VCOM_B 132 at the time 212 may be approximately the difference between the voltage 214 and the voltage 230. As previously described, such a voltage difference 142 may decrease the quality of an image on the display 18. Accordingly, the display 18 uses this voltage difference 142 to control the rate that the activation signal is removed from the pixels 102 (e.g., via the gate line 104) to decrease the voltage difference 142. Specifically, during segment 204 of the gate line 104, the display 18 uses the voltage difference 142 between the VCOM_A 130 and the VCOM_B 132 to change the rate that the activation signal is removed from the pixels 102. For example, the voltage difference 142 is reduced from its value at time 210 to a voltage difference 142 of the difference between the voltage 222 and the voltage 236 at the time 220. Further, during segments 224 and 238 the voltage difference 142 may be reduced to approximately zero.

Figure 9:
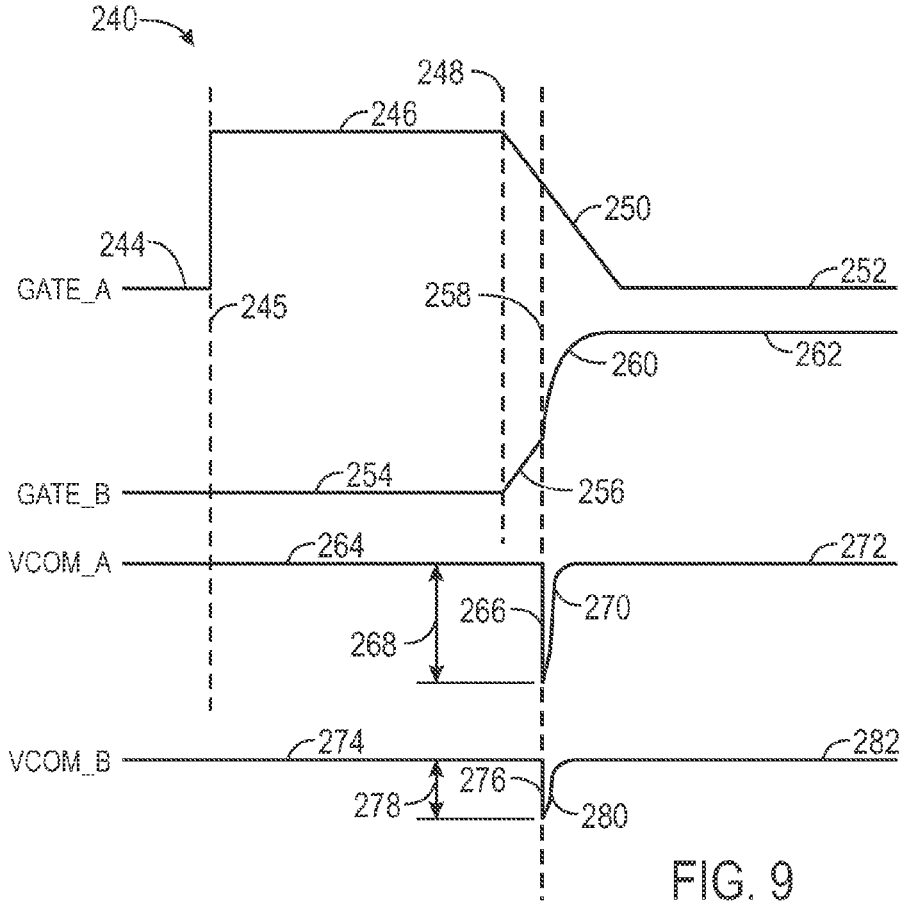
FIG. 9 is a timing diagram illustrating a reduction of a voltage difference between VCOMs of an LCD by controlling a time that an activation signal is applied to pixels to improve image quality of the LCD, in accordance with an embodiment.

In some embodiments, the time that an activation signal is applied to pixels 102 is controlled to decrease the voltage difference between VCOMs. FIG. 9 illustrates one embodiment of a timing diagram 240 that shows a reduction of the voltage difference 142 between VCOMs of the display 18 by controlling a time that a voltage on a second gate line 104 (e.g., GATE_B) is applied to pixels 102 to improve image quality of the display 18. As illustrated by segment 244, the first gate line 104 (e.g., GATE_A) may start in a logic low (deactivated) state. At a time 245, the first gate line 104 may transition to a logic high (activated) state where it remains through segment 246. At a time 248, the gate line 104 may transition toward the logic low state at a fixed rate, during segment 250. After the first gate line 104 reaches the logic low state, the first gate line 104 remains in the logic low state, as shown by segment 252.

As illustrated by segment 254, the second gate line 104 (e.g., GATE_B) may start in a logic low (deactivated) state. At the time 248, the second gate line 104 may transition toward a logic high (activated) state at a fixed rate, as shown by segment 256. The fixed rate of transition may be a predetermined rate configured to be applied for a fixed period of time (e.g., until a time 258). At the time 258, the transition rate toward the logic high state may become variable (e.g., actively controlled) and may be based on the voltage difference 142, in order to decrease the voltage difference 142 between the VCOM_A 130 and the VCOM_B 132, as shown by segment 260. After the second gate line 104 reaches the logic high state, the second gate line 104 remains in the logic high state, as shown by segment 262.

In the present embodiment, a voltage is applied to the VCOM_A 130 during segment 264. At the time 258, a kickback voltage alters the voltage of the VCOM_A 130, as shown by segment 266. As illustrated, the voltage of the VCOM_A 130 may change by a voltage 268. The voltage of the VCOM_A 130 then returns to the voltage applied during segment 264, as shown by segment 270. Segment 270 corresponds to the rate that the second gate line 104 is activated during segment 260. During segment 262, the voltage of the VCOM_A 130 may be approximately the same as the voltage applied during segment 264.

A voltage is applied to the VCOM_B 132 during segment 274. At the time 258, a kickback voltage alters the voltage of the VCOM_B 132, as shown by segment 276. As illustrated, the voltage of the VCOM_B 132 may change by a voltage 278. The voltage of the VCOM_B 132 then returns to the voltage applied during segment 274, as shown by segment 280. Segment 280 corresponds to the rate that the second gate line 104 is activated during segment 260. During segment 282, the voltage of the VCOM_B 132 may be approximately the same as the voltage applied during segment 274.

In certain embodiments, the voltage applied to the VCOM_A 130 and the VCOM_B 132 may be approximately the same and, therefore, the voltage difference 142 between the VCOM_A 130 and the VCOM_B 132 during segments 264 and 274 may be approximately zero. Furthermore, the voltage difference 142 between the VCOM_A 130 and the VCOM_B 132 at the time 258 may be approximately the difference between the voltage 268 and the voltage 278. As previously described, such a voltage difference 142 may decrease the quality of an image on the display 18. Accordingly, the display 18 uses this voltage difference 142 to control the rate and/or timing that the activation signal is applied to the pixels 102 (e.g., via the second gate line 104) to decrease the voltage difference 142. Specifically, during segment 260 of the second gate line 104, the display 18 uses the voltage difference 142 between the VCOM_A 130 and the VCOM_B 132 to change the rate that the activation signal is applied to the pixels 102. For example, the voltage difference 142 is reduced from its value at time 258 to a voltage difference 142 of approximately zero during segments 272 and 282.

Figure 10:
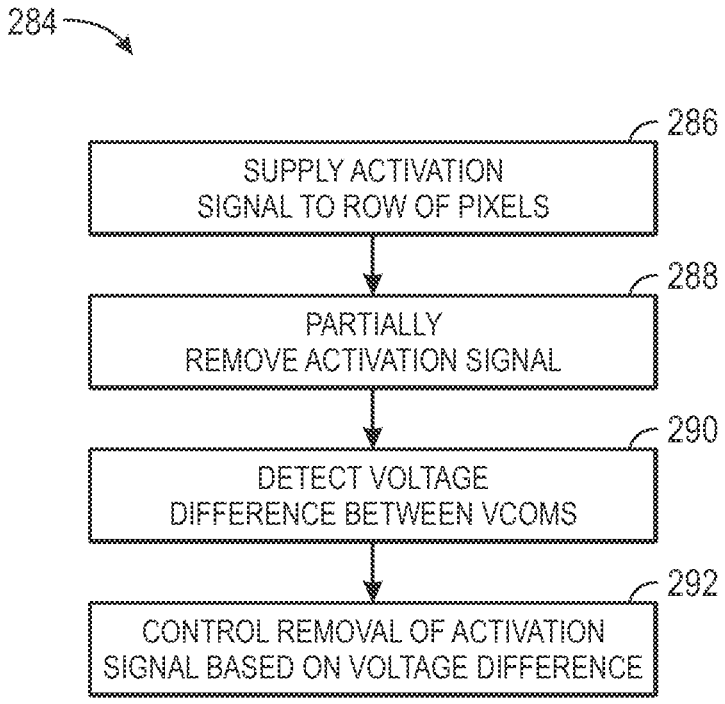
FIG. 10 is a flowchart describing a method for reducing a voltage difference between VCOMs of an LCD by controlling removal of an activation signal from pixels of the LCD to improve image quality of the LCD, in accordance with an embodiment.

As presented above, the display 18 may use a series of operations for reducing the voltage difference 142 to improve image quality of the display 18. FIG. 10 illustrates one embodiment of a method 284 for reducing the voltage difference 142 between VCOMs of the display 18 by controlling removal of an activation signal from pixels 102 of the display 18. An activation signal is supplied to a row of pixels 102 of the display 18 to activate the pixels (block 286). For example, the activation signal may be supplied to the pixels 102 via the first gate line 104 (e.g., GATE_A). Further, the activation signal is partially removed from the row of pixels 102 at a predetermined rate (block 288). In certain embodiments, the predetermined rate may be a fixed rate for a fixed period of time. The predetermined rate may be any suitable rate, such as a rate that will result in a minimal voltage difference 142 between VCOMs. A first voltage difference 142 is detected between a first VCOM (e.g., VCOM_A 130) of a first set of pixels 102 of the display 18 and a second VCOM (e.g., VCOM_B 132) of a second set of pixels 102 of the display 18, after the activation signal has been partially removed (block 290). The first voltage difference 142 may be detected using the voltage sensing device 146, such as a differential amplifier. Removal of the activation signal from the row of pixels 102 is controlled and may be based at least partially on the detected voltage difference 142 (block 292). In certain embodiments, the controlled removal of the activation signal may include changing a rate that the activation signal is removed. The controlled removal of the activation signal may also include determining a rate that the activation signal is to be removed. In some embodiments, controlling removal of the activation signal may include retrieving a rate that the activation signal is to be removed from a mapping table that correlates voltage differences 142 with rates that the activation signal is to be removed.

Controlling removal of the activation signal may also include controlling application of a second activation signal (e.g., via the second gate line 104) to a second row of pixels 102. In certain embodiments, the application of the second activation signal may occur while the activation signal is being removed. To control removal of the activation signal, a second voltage difference 142 between the first VCOM and the second VCOM may be detected. The controlled removal of the activation signal may be based at least partially on the second voltage difference 142. Further, the voltage difference 142 may regularly be detected, and the removal of the activation signal may be based at least partially on each detected voltage difference 142 (e.g., the voltage difference 142 may provide active feedback to the activation signal driving circuitry). Accordingly, reduced image quality, which may result from a voltage difference 142 between the VCOMs, may be improved by minimizing the voltage difference 142 between the VCOMs.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method for reducing a voltage difference between common voltage layers (VCOMs) of a display to improve image quality of the display, comprising:

supplying an activation signal to a row of pixels of the display to activate the row of pixels;

partially removing the activation signal from the row of pixels at a predetermined rate;

detecting a first voltage difference between a first VCOM of a first set of pixels of the display and a second VCOM of a second set of pixels of the display after the activation signal has been partially removed; and controlling removal of the activation signal from the row of pixels based at least partially on the detected first voltage difference.

2. The method of claim 1, wherein controlling the removal of the activation signal from the row of pixels comprises changing a rate that the activation signal is removed.

3. The method of claim 1, wherein controlling the removal of the activation signal from the row of pixels comprises determining a rate that the activation signal is to be removed.

4. The method of claim 1, wherein controlling the removal of the activation signal from the row of pixels comprises retrieving a rate that the activation signal is to be removed from a mapping table that correlates voltage differences with rates that the activation signal is to be removed.

5. The method of claim 1, wherein controlling the removal of the activation signal from the row of pixels comprising controlling application of a second activation signal to a second row of pixels.

6. The method of claim 5, wherein the second activation signal is supplied while the activation signal is being removed.

7. The method of claim 1, wherein the row of pixels comprises a first subset of the first set of pixels and a second subset of the second set of pixels.

8. The method of claim 1, wherein detecting the voltage difference between the first VCOM of the first set of pixels and the second VCOM of the second set of pixels comprises detecting the voltage difference using a differential amplifier.

9. The method of claim 1, wherein detecting the voltage difference between the first VCOM of the first set of pixels and the second VCOM of the second set of pixels comprises receiving the voltage difference from a voltage sensing device.

10. The method of claim 1, comprising detecting a second voltage difference between the first VCOM and the second VCOM after the activation signal has been partially removed.

11. The method of claim 10, comprising controlling removal of the activation signal from the row of pixels based at least partially on the detected second voltage difference.

12. An electronic display comprising:

a first set of pixels having a first common voltage device (VCOM);

a second set of pixels having a second VCOM;

a gate driver configured to supply an activation signal to the first set of pixels and the second set of pixels concurrently;

a voltage sensing device configured to detect a first voltage difference between the first VCOM and the second VCOM; and a control device configured to control features associated with supplying the activation signal, removing the activation signal, or some combination thereof, wherein the control of the activation signal is based at least partially on the first voltage difference detected by the voltage sensing device.

13. The electronic display of claim 12, comprising a first row of pixels having the first set of pixels and the second set of pixels.

14. The electronic display of claim 12, comprising a third set of pixels having a third VCOM and a fourth set of pixels having a fourth VCOM.

15. The electronic display of claim 14, wherein the first VCOM and the third VCOM are each approximately a first size, and the second VCOM and the fourth VCOM are each approximately a second size.

16. The electronic display of claim 14, wherein the voltage sensing device is configured to detect a second voltage difference between the third VCOM and the fourth VCOM.

17. The electronic display of claim 16, wherein the first voltage difference and the second voltage difference are approximately the same.

18. The electronic display of claim 14, wherein the first VCOM is coupled to the third VCOM and the second VCOM is coupled to the fourth VCOM.

19. An electronic device comprising:

a housing;

a processor disposed within the housing;

one or more input structures configured to transmit input signals to the processor; and an electronic display coupled to the housing and configured to supply an activation signal to a row of pixels having a first portion coupled to a first common voltage device (VCOM) and a second portion coupled to a second VCOM, partially remove the activation signal from the row of pixels at a predetermined rate, detect a voltage difference between the first VCOM and the second VCOM after the activation signal has been partially removed, and control removal of the activation signal from the row of pixels based at least partially on the detected voltage difference.

20. The electronic device of claim 19, wherein the electronic display comprises a sensing device configured to detect the voltage difference between the first VCOM and the second VCOM.

* * * * *